US005858628A

United States Patent [19]

Yoshida et al.

[11] Patent Number: 5,858,628

[45] Date of Patent: Jan. 12, 1999

[54] BLACK THERMAL TRANSFER SHEET

[75] Inventors: Kazuya Yoshida; Hiroshi Eguchi, both of Tokyo-to, Japan

[73] Assignee: Dai Nippon Printing Co., Ltd., Japan

[21] Appl. No.: 927,789

[22] Filed: Sep. 11, 1997

[30] Foreign Application Priority Data

Sep. 13, 1996 [JP] Japan ..... 8-263764

[51] Int. Cl.[6] ..... G03C 8/10

[52] U.S. Cl. ..... 430/338; 430/201; 430/964; 8/471; 503/227

[58] Field of Search ..... 430/201, 964, 430/338; 8/471; 503/227

[56] References Cited

U.S. PATENT DOCUMENTS

| | | | |
|---|---|---|---|
| 5,326,666 | 7/1994 | Vanmaele et al. | 430/201 |
| 5,503,956 | 4/1996 | Kaszczuk et al. | 430/201 |

FOREIGN PATENT DOCUMENTS

| | | |
|---|---|---|
| 423796A | 4/1991 | European Pat. Off. . |
| 672541A | 9/1995 | European Pat. Off. . |
| 743194A | 11/1996 | European Pat. Off. . |
| 754563A | 1/1997 | European Pat. Off. . |

OTHER PUBLICATIONS

"Azomethine Dyes. I. Color and Constitution of Pyrazolone Azomethine Dyes" (XP 002049362) Brown et al., J. Am. Chem. Soc., vol. 73, Mar. 1951.

*Primary Examiner*—Richard L. Schilling

*Attorney, Agent, or Firm*—Ladas & Parry

[57] ABSTRACT

A black thermal transfer sheet comprises a substrate film and a black dye layer formed on one surface of the substrate film. The die layer comprises dye and a binder. The dye comprises a first dye and a second dye respectively expressed by the following formulae (1) and (2):

(1)

(where, "$R^1$" and "$R^2$" represent a substitutional or non-substitutional alkyl group, etc., "$R^3$" represents a hydrogen atom, etc., "$R^4$" represents a substitutional or non-substitutional alkyl group, etc., and "$R^5$" represents a substitutional or non-substitutional aminocarbonyl group, etc.; and "n" represents an integer of 1 or 2); and (2)

(where, "$R^1$", "$R^2$", "$R^3$" and "n" represent the same definitions as those in the formula (1), and "$R^6$" and "$R^7$" represent a substitutional or non-substitutional alkyl group, etc.).

2 Claims, 2 Drawing Sheets

BLACK THERMAL TRANSFER SHEET

BACKGROUND OF THE INVENTION

1. Field of the Invention

The present invention relates to a thermal transfer sheet utilizing a sublimative dye, and more specifically to a black thermal transfer sheet which permits to form an image having a high density in black color and a high color rendering property, and excellent in fastness against heat and light.

2. Description of the Related Art

A gradation image or a monotone image such as characters, symbols or the like has conventionally been formed on an image receiving sheet by means of a thermal transfer printing method. With respect to such a thermal transfer printing method, there have widely been applied a sublimation type thermal transfer printing method and a heat-fusion type thermal transfer printing method.

Of these printing methods, according to the sublimation type thermal transfer printing method, an image is formed by placing, on an image receiving sheet, a thermal transfer sheet in which a dye layer obtained by dissolving or dispersing a sublimative dye used as a coloring agent into a binder made of resin, has previously been carried on a substrate film, and impressing energy corresponding to image information by means of a heating means such as a thermal head or a laser, to cause the dye contained in the sublimative dye layer on the thermal transfer sheet to transfer into the image receiving sheet, thereby forming the image.

According to the above-described sublimation type thermal transfer printing method, it is possible to control a transferred amount of dye in a unit of a single dot by changing an amount of energy to be impressed to the thermal transfer sheet, with the result that there can be formed an image with gradation in full colors, thus leading to realization of an image having a high quality which is equal to an image obtained by a silver film. Public attention has therefore been attracted by such a sublimation type thermal transfer printing method, and this method has been utilized as an information recording means in many kinds of field of art.

Along with the development of various hardware and software having a relationship to multimedia, the market of products for the sublimation type thermal transfer printing method has been enlarged in a hard copy system in full color such as a static image obtained by a computer-graphics, satellite communications or the like, a digital image obtained by an exemplary CD-ROM or the like, and an analog image obtained by a video recorder.

There are many actual uses of the image receiving sheet utilizing the sublimation type thermal transfer printing method. There can be mentioned exemplary uses such as output of proofs or images for printing; output of a blueprint and a design with the use of a CAD, a CAM or the like; output for many kinds of medical analyzing or measuring equipment such as a CT scanner, a camera for an endoscope or the like; output of a photograph of a person's face of cards such as an identification card, a credit card or the like, and output of a composite photograph or a commemorative photograph in an amusement park, a video arcade, a museum, an aquarium or the like.

In the thermal transfer sheet utilizing the above-described sublimation type thermal transfer printing method, a color reproducibility, in particular, a black color reproducibility with a high density is required as an important feature. More specifically, when an attempt is made to perform the reproduction in full color with the use of three primary colors of yellow, magenta and cyan, a dye layer exclusive to the black color is required, because the color reproducibility of jet-black color is poor due to restrictions in the subtractive process, the thermal transfer technique or the like.

With respect to a black thermal transfer sheet having a dye layer exclusive to the black color, it has been known to mix the dyes of yellow, magenta and cyan to obtain a black dye layer. This method is disclosed in for example, Japanese Patent Provisional Publication No. S61-258,791, No. H1-1136,787, No. H3-205,188, No. H4-267,197 and No. H7-232,481.

However, absorption spectrum of the black color obtained by mixing three primary colors of yellow, magenta and cyan has absorption wave troughs in the vicinity of 490 nm and 580 nm, thus causing a problem that the black color may visually be perceived in different color by an illumination light having a different wavelength. In general, this phenomenon is called "color rendering".

In the field of fiber dyeing, it is known to add an orange dye or a violet dye other than three primary colors, in order to improve the color rendering property.

However, in the field of the thermal transfer recording, a vigorous development in a dye of intermediate color has not as yet been made, and there has not been found out a dye of intermediate color having an excellent fastness against heat and light, and an excellent stability in an image receiving sheet after the completion of the thermal printing.

In addition, when a dye having a different hue was mixed, there has often been recognized a phenomenon of occurrence of intense discoloration by means of light. In general, this phenomenon is called "catalytic discoloration by light". The black dye layer contains a dye having a different due mixed therein, and accordingly, there is a problem that the catalytic discoloration by light tends to easily occur.

SUMMARY OF THE INVENTION

The object of the present invention is therefore to provide a black thermal transfer sheet which permits to solve the above-mentioned problems and to form an image having a high density in black color and a high color rendering property, and an excellent fastness against heat and light.

The black thermal transfer sheet of present invention for attainment of the aforementioned object, comprises a substrate film and a black dye layer formed on one surface of said substrate film, which die layer comprises dye and a binder, wherein:

said dye comprises a first dye and a second dye respectively expressed by the following formulae (1) and (2):

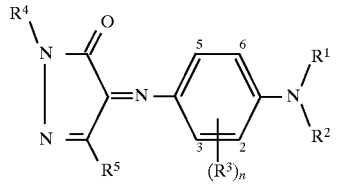

(1)

(where, "$R^1$" and "$R^2$" represent a substitutional or non-substitutional alkyl group, a substitutional or non-substitutional cycloalkyl group, a substitutional or non-substitutional aralkyl group, or a substitutional or non-substitutional aryl group, "$R^3$" represents a hydrogen atom, a halogen atom, a cyano group, a hydroxyl group, a substitutional or non-substitutional alkyl group, a substitutional or non-substitutional alkoxy group, a substitutional or non-substitutional cycloalkyl group, a substitutional or non-substitutional aralkyl group, a substitutional or non-substitutional aryl group, a substitutional or non-substitutional acyl group, a substitutional or non-substitutional acylamino group or a substitutional or non-substitutional sulfonylamino group, "$R^4$" represents a substitutional or non-substitutional alkyl group, a substitutional or non-substitutional cycloalkyl group, a substitutional or non-substitutional aralkyl group, and "$R^5$" represents a substitutional or non-substitutional aminocarbonyl group, a substitutional or non-substitutional alkoxycarbonyl group or a substitutional or non-substitutional aryloxycarbonyl group; and "n" represents an integer of 1 or 2); and

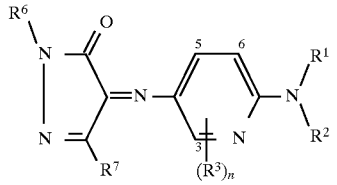

(2)

(where, "$R^1$", "$R^2$", "$R^3$" and "n" represent the same definitions as those in the formula (1), and "$R^6$" and "$R^7$" represent a substitutional or non-substitutional alkyl group, a substitutional or non-substitutional cycloalkyl group, a substitutional or non-substitutional aralkyl group, or a substitutional or non-substitutional aryl group).

When at least one dye of three primary colors of yellow, magenta and cyan is used in a black dye layer of a black thermal transfer sheet, light absorption occurs in a certain wavelength region corresponding to hue of the dye as used, and there exists on the other hand a wavelength region having a low light-absorptivity. As a result, the black color may visually be perceived in different color by an illumination light in the above-mentioned wavelength region having a low light-absorptivity.

In the present invention, by causing the black dye layer to contain the first and second dyes which are respectively expressed by the formulae (1) and (2) and have violet and orange hue as intermediate colors, respectively, it is possible to supplement light absorption in the wavelength region having a low light-absorptivity, so as to provide black hue having a stable light-absorptivity in the wide wavelength range, thus performing a high color rendering property and a high density in black color.

The first and second dyes respectively expressed by the formulae (1) and (2) are excellent in fastness against heat and light, thus permitting the improvement in fastness against heat and light of an image formed with the use of the black dye layer.

The above-mentioned dye may further comprises a third dye expressed by the following formula (3):

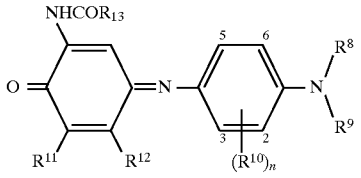

(3)

(where, "$R^8$" and "$R^9$" represent a substitutional or non-substitutional alkyl group, a substitutional or non-substitutional cycloalkyl group, a substitutional or non-substitutional aralkyl group, or a substitutional or non-substitutional aryl group, "$R^{10}$" represents a hydrogen atom, a halogen atom, a cyano group, a hydroxyl group, a substitutional or non-substitutional alkyl group, a substitutional or non-substitutional alkoxy group, a substitutional or non-substitutional cycloalkyl group, a substitutional or non-substitutional aralkyl group, a substitutional or non-substitutional aryl group, a substitutional or non-substitutional acyl group, a substitutional or non-substitutional acylamino group or a substitutional or non-substitutional sulfonylamino group, "$R^{11}$" represents a hydrogen atom or a halogen atom, "$R^{12}$" represents a hydrogen atom or a substitutional or non-substitutional alkyl group, "$R^{13}$" represents a substitutional or non-substitutional alkyl group, a substitutional or non-substitutional cycloalkyl group, a substitutional or non-substitutional aralkyl group, a substitutional or non-substitutional aryl group or a substitutional or non-substitutional alkoxy group; and "n" represents an integer of 1 or 2).

Extensive studies were carried out to obtain a finding that the above-mentioned black thermal transfer sheet of the present invention permitted to form an image having a high density in black color and a high color rendering property, and excellent in fastness against heat and light. The present invention was made on the basis of the above-mentioned finding.

DETAILED DESCRIPTION OF THE PREFERRED EMBODIMENTS

Figure 1:
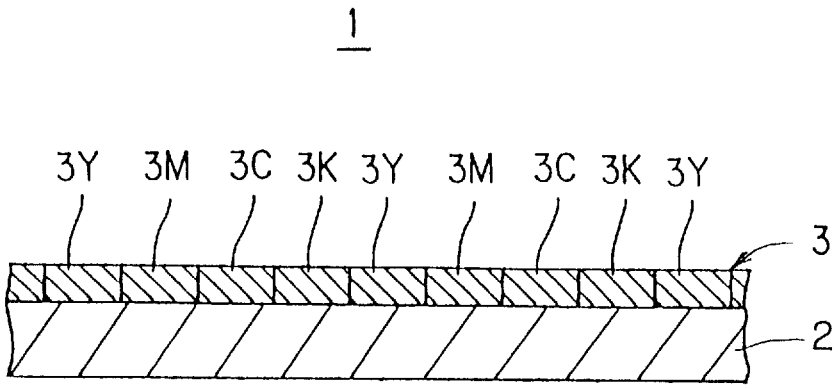
FIG. 1 is a schematic cross sectional view illustrating a black thermal transfer sheet of the first embodiment of the present invention.

Now, the black thermal transfer sheet of the first embodiment of the present invention will be described in detail with reference to FIG. 1. FIG. 1 is a schematic cross sectional view illustrating the black thermal transfer sheet of the aforementioned first embodiment of the present invention.

As shown in FIG. 1, the black thermal transfer sheet 1 of the first embodiment of the present invention comprises a substrate film 2 and a black dye layer 3 formed on one surface of the substrate film 2. The black dye layer 3 comprises dye and a binder. The black thermal transfer sheet 1 of the present invention is characterized in that the above-mentioned dye comprises a first dye and a second dye respectively expressed by the formulae (1) and (2) set forth below. Except for this feature, the black thermal transfer sheet 1 of the present invention may have the same structure as that of the conventional thermal transfer sheet. The first dye and the second dye respectively expressed by the formulae (1) and (2) may be prepared on the basis of the conventional method for preparing dye.

In the present invention, the first dye and the second dye respectively expressed by the formulae (1) and (2) may be used in their combination, and in combination with other dye in order to adjust hue of the black color Description will be given below of the substrate film 2 and the dye layer 3.

[Substrate film]

As a substrate film 2 in the black thermal transfer sheet 1 of the present invention, the same substrate film as that used in the conventional thermal transfer sheet may per se be used. There is however no specific restriction thereto.

The preferable example of the substrate film 2 may include polyester, polypropylene, cellophane, polycarbonate, cellulose acetate, polyethylene, polyvinyl chloride, polystyrene, nylon, polyimide, polyvinylidene chloride, polyvinyl alcohol, fluorine resin, chlorinated rubber, plastic film such as ionomer, paper such as glassine, condenser paper or the like, or nonwoven fabric. The substrate film 2 may be formed in composite form of these materials.

The thickness of the substrate film 2 may appropriately be changed so that the required strength and thermal conductivity can be obtained. The substrate film 2 has for example a thickness of from 3 to 100 $\mu$m.

When the substrate film 2 has a poor adhesiveness to the dye layer formed on the surface thereof, it is preferable to subject the surface of the substrate film 2 to a primer processing (an adhesion-facilitating processing) or a corona discharge processing.

[Dye layer]

The dye layer 3 sufficed the black thermal transfer sheet of the present invention. In the first embodiment of the present invention, the dye layer 3 however comprises four kinds of layers of Yellow (3Y), Magenta (3M), Cyan (3C) and Black (3K) which are formed on the front surface of the substrate film 2 side by side in this order, as shown in FIG. 1. The black thermal transfer sheet may be prepared by forming only the single layer of Black on the front surface of the substrate film 2, and in this case, there are used, in combination with the thus prepared black thermal transfer sheet, the other single thermal transfer sheet or plural thermal transfer sheets in which a plural kinds of layers of Yellow (3Y), Magenta (3M) and Cyan (3C) are formed on a single substrate film or the respective substrate films.

The dye layer 3 comprises the first dye and the second dye respectively expressed by the following formulae (1) and (2):

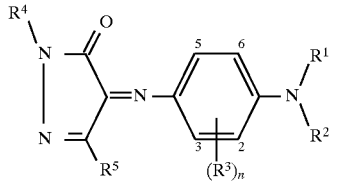

(1)

(where, "$R^1$" and "$R^2$" represent a substitutional or non-substitutional alkyl group, a substitutional or non-substitutional cycloalkyl group, a substitutional or non-substitutional aralkyl group, or a substitutional or non-substitutional aryl group, "$R^3$" represents a hydrogen atom, a halogen atom, a cyano group, a hydroxyl group, a substitutional or non-substitutional alkyl group, a substitutional or non-substitutional alkoxy group, a substitutional or non-substitutional cycloalkyl group, a substitutional or non-substitutional aralkyl group, a substitutional or non-substitutional aryl group, a substitutional or non-substitutional acyl group, a substitutional or non-substitutional acylamino group or a substitutional or non-substitutional sulfonylamino group, "$R^4$" represents a substitutional or non-substitutional alkyl group, a substitutional or non-substitutional cycloalkyl group, a substitutional or non-substitutional aralkyl group, and "$R^5$" represents a substitutional or non-substitutional aminocarbonyl group, a substitutional or non-substitutional alkoxycarbonyl group or a substitutional or non-substitutional aryloxycarbonyl group; and "n" represents an integer of 1 or 2); and

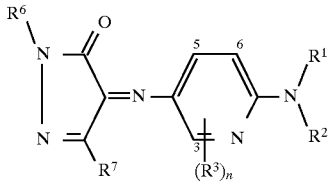

(2)

(where, "$R^1$", "$R^2$", "$R^3$" and "n" represent the same definitions as those in the formula (1), and "$R^6$" and "$R^7$" represent a substitutional or non-substitutional alkyl group, a substitutional or non-substitutional cycloalkyl group, a substitutional or non-substitutional aralkyl group, or a substitutional or non-substitutional aryl group).

Exemplary dyes expressed by the formula (1), used as the first dye in the present invention are listed in TABLE 1 below.

TABLE 1

| No. | $R^1$ | $R^2$ | $R^3$ | $R^4$ | $R^5$ |
|---|---|---|---|---|---|
| 1 | $-C_2H_5$ | $-C_2H_5$ | —H | $-CH_3$ | $-COOCH_3$ |
| 2 | $-C_2H_5$ | $-C_2H_5$ | 3-$CH_3$ | $-CH_3$ | $-COOCH_3$ |
| 3 | $-C_2H_5$ | $-C_2H_5$ | 3-$CH_3$ | benzyl | $-CONHC_3H_7$ |
| 4 | $-C_2H_5$ | $-C_2H_5$ | 3-$CH_3$ | $-C_4H_9$(n) | $-COOC_2H_5$ |
| 5 | $-C_2H_5$ | $-C_2H_4OH$ | 3-$CH_3$ | cyclohexyl | $-CON(CH_3)_2$ |
| 6 | $-C_2H_5$ | $-C_2H_5$ | 3-$CH_3$ 6-$OCH_3$ | $-CH_3$ | $-COOC_2H_5$ |

In TABLE 1, "$R^4$" in the dye No. 4 represents normal-butyric group.

Exemplary dyes expressed by the formula (2), used as the second dye in the present invention are listed in TABLE 2 below.

TABLE 2

| No. | $R^1$ | $R^2$ | $R^3$ | $R^6$ | $R^7$ |
|---|---|---|---|---|---|
| 1 | $-C_2H_5$ | $-C_2H_5$ | 3-$CH_3$ | p-toluyl | $-CH_3$ |
| 2 | $-C_2H_5$ | $-C_2H_5$ | 3-$CH_3$ | phenyl | $-C_3H_7OH$ |
| 3 | $-C_2H_5$ | $-C_2H_4OH$ | —H | 2,4,6-trichloro-phenyl | $-CH_3$ |
| 4 | $-C_2H_5$ | $-C_2H_5$ | —H | m-toluyl | benzyl |
| 5 | $-C_2H_5$ | $-C_2H_5$ | 3-$CH_3$ | phenyl | cyclohexyl |

Further, in the present invention, it is preferable to add cyanic dye expressed by the following formula (3) to the black dye layer 3, in other words, the dye used in the present invention preferably further comprises the third dye expressed by the following formula (3):

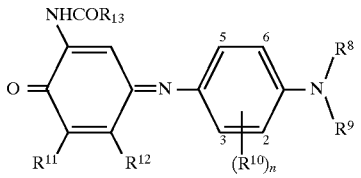

(3)

(where, "$R^8$" and "$R^9$" represent a substitutional or non-substitutional alkyl group, a substitutional or non-substitutional cycloalkyl group, a substitutional or non-substitutional aralkyl group, or a substitutional or non-substitutional aryl group, "$R^{10}$" represents a hydrogen atom, a halogen atom, a cyano group, a hydroxyl group, a substitutional or non-substitutional alkyl group, a substitutional or non-substitutional alkoxy group, a substitutional or non-substitutional cycloalkyl group, a substitutional or non-substitutional aralkyl group, a substitutional or non-substitutional aryl group, a substitutional or non-substitutional acyl group, a substitutional or non-substitutional acylamino group or a substitutional or non-substitutional sulfonylamino group, "$R^{11}$" represents a hydrogen atom or a halogen atom, "$R^{12}$" represents a hydrogen atom or a substitutional or non-substitutional alkyl group, "$R^{13}$" represents a substitutional or non-substitutional alkyl group, a substitutional or non-substitutional cycloalkyl group, a substitutional or non-substitutional aralkyl group, a substitutional or non-substitutional aryl group or a substitutional or non-substitutional alkoxy group; and "n" represents an integer of 1 or 2).

Exemplary dyes expressed by the formula (3), used as the third dye in the present invention are listed in TABLE 3 below.

TABLE 3

| No. | $R^8$ | $R^9$ | $R^{10}$ | $R^{11}$ | $R^{12}$ | $R^{13}$ |
|---|---|---|---|---|---|---|
| 1 | $—C_2H_5$ | $—C_2H_5$ | 3-$CH_3$ | —Cl | $—CH_3$ | $—CH_3$ |
| 2 | $—C_2H_5$ | $—C_2H_5$ | 3-$CH_3$ | —Cl | $—C_2H_5$ | $—OC_2H_5$ |
| 3 | $—C_2H_5$ | $—C_2H_5$ | 3-$CH_3$ | —H | —H | phenyl |
| 4 | $—C_2H_5$ | $—C_2H_5$ | —H | —H | $—NHCOC_4H_9$ | $—C_3H_7$(i) |

In TABLE 3, "$R^{13}$" in the dye No. 4 represents isopropyl group.

The mixing ratio of the first dye expressed by the formula (1) and the second dye expressed by the formula (2) is preferably within a range of from 1:0.8 to 1:1.4. When the third dye expressed by the formula (3) is used, it is possible to obtain a desired black hue by maintain the mixing ratio of the first dye and the third dye within a range of from 1:1 to 1:2.7.

In the preparation of the black dye layer, a binder is added together with the above-mentioned dyes. Any conventional resin binder may be used as a binder, and representative examples of the binder may include cellulosic resins such as ethyl cellulose, hydroxy-ethyl cellulose, hydroxy-propyl cellulose, methyl cellulose, cellulose acetate and cellulose butyrate; vinyl resins such as polyvinyl alcohol, polyvinyl acetate, polyvinyl butylal, polyvinyl acetal, polyvinyl pyrrolidon and polyacrylamide; and polyester resins. Of these materials, cellulosic resins, acetal resins, butylal resins and polyester resins are preferably used in view of a heat resistance property and transfer property of dye.

In the present invention, graft copolymer having releasability may be used as a releasing agent or a binder, in replacement of the above-mentioned resin binder. The graft copolymer is prepared by graft-coupling at least one type of releasing segment selected among polysiloxane segment, carbon fluoride segment, hydrocarbon fluoride segment and long-chain alkyl segment, with main chains of polymer. It is preferable to use graft copolymer prepared by graft-coupling polysiloxane segment with main chains of polyvinyl acetal resin.

In the preparation of the black dye layer, the conventional many kinds of additives may be added together with the above-described dye and binder, if necessary. Exemplary additives may include organic fine particles such as polyethylene wax, and inorganic fine particles, for improving releasability of the image receiving sheet and applying property of ink.

In a normal manner, the black dye layer 3 is prepared by adding the above-described dyes and binder, and, if necessary, additives, into an appropriate solvent, and dissolving or dispersing these ingredients into the solvent to prepare a black dye layer forming composition; applying the thus prepared black dye layer forming composition onto the surface of the substrate film 2; and drying same. The application of the black dye layer forming composition may be carried out with the use of the conventional method of gravure printing, screen printing, reverse-roll coating using gravure plates, or the like. The thus prepared black dye layer 3 has a thickness of from 0.2 to 6.0 μm, preferably from 0.4 to 3.0 μm in a drying condition. The total amount of dyes contained in the black dye layer 3, which include the first to third dyes respectively expressed by the formulae (1) to (3) and the other dyes, is within a range of from 5 to 70 wt. %, preferably of from 10 to 60 wt. % relative to the weight of the black dye layer 3.

Description will be given below of an image receiving sheet to be used in combination with the above-described black thermal transfer sheet 1 of the first embodiment of the present invention.

There may be applicable any kind of image receiving sheet serving as a sheet onto which an image is transferred, which is to be used for the formation of the image with the use of the above-described black thermal transfer sheet 1 of the present invention, provided that the image receiving surface thereof has a dye receiving property relative to the above-described dyes. When there is used a sheet of paper, metal, glass, synthetic resin, having no dye receiving property, a dye receptor layer may be formed on at least one surface thereof.

As an image-receiving sheet which is dye-receivable itself and does not require to have the dye receptor layer, for example, there may be used a sheet composed of fiber, woven cloth, a film, a sheet, or a molded product, which is made of a material including polyolefin resins such as polypropylene; halogenated polymer such as polyvinyl chloride or polyvinylidene chloride; vinyl polymer such as polyvinyl acetate or polyacrylic ester; polyester resins such as polyethylene telephthalate or polybutylene terephthalate; polystylene resin; polyamide resin; copolymer resin in combination of olefin such as ethylene or propylene with another vinyl monomer; ionomer; cellulosic resin such as cellulose diacetate; polycarbonate and the like.

In particular, there may preferably be used a sheet or film made of polyvinyl chloride, and it may have a single layer or multi-laminated layer structure.

Even when there is used a sheet of paper, metal, glass, or the like, having no dye receiving property, it is possible to use, as an image receiving sheet, such a sheet provided with a resin film having a dye receiving property, which has been obtained by applying a solution or dispersing liquid of the resin having the dye receiving property on the surface of the above-mentioned sheet, and drying same, or by laminating the above-mentioned sheet with the resin film.

Even when there is used a sheet having the dye receiving property, the above-described dye receptor layer made of resin having more excellent dye receiving property, may be formed on the surface of the sheet. The thus formed dye receptor layer may be made of a single material or a plurality of materials. Many kinds of additives may naturally be added to the extent that the object of the present invention is not obstructed.

The receptor layer is prepared by dissolving or dispersing the above-described resin and additives into an appropriate solvent to prepare a receptor layer forming composition, applying the thus prepared receptor layer forming composition onto the surface of the above-mentioned sheet by means of the conventional method of gravure printing, screen printing, reverse-roll coating using gravure plates, or the like, and drying same.

Any one of the conventional energy applying means may be used when the thermal transfer printing is carried out with the use of the above-described thermal transfer sheet 1 of the present invention and the image receiving sheet. A prescribed object can, for example, be achieved by applying heat energy of from about 5 to 100 mj/mm$^2$, while controlling the recording time with the use of a recording apparatus such as a thermal transfer printer (for example, the video printer VY-100 manufactured by HITACHI CO., LTD.).

Figure 2:
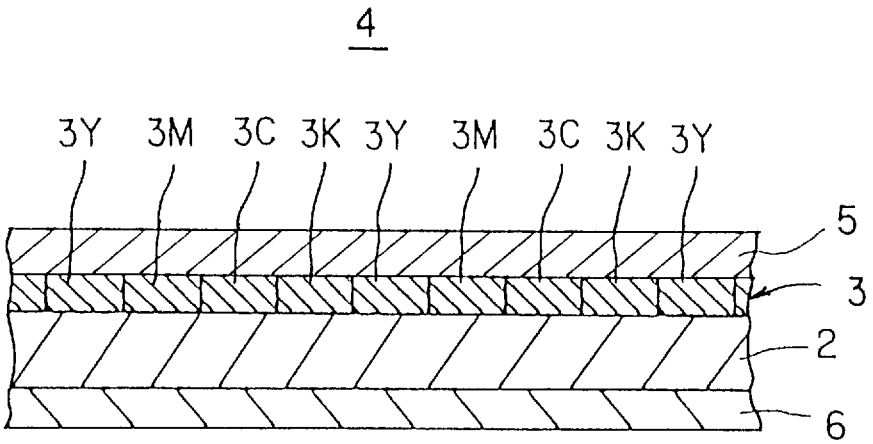
FIG. 2 is a schematic cross sectional view illustrating a black thermal transfer sheet of the second embodiment of the present invention.

Then, the black thermal transfer sheet of the second embodiment of the present invention will be described in detail with reference to FIG. 2. FIG. 2 is a schematic cross sectional view illustrating the black thermal transfer sheet of the aforementioned second embodiment of the present invention.

As shown in FIG. 2, the black thermal transfer sheet 4 of the second embodiment of the present invention comprises a substrate film 2, a black dye layer 3 formed on one surface of the substrate film 2, a releasing layer 5 formed on the black dye layer 3 and a heat-resisting layer 6 formed on the other surface of the substrate film 2.

More specifically, the black thermal transfer sheet 4 of the second embodiment of the present invention is identical to the black thermal transfer sheet 1 of the first embodiment of the present invention except that the former has the releasing layer 5 and the heat-resisting layer 6. The same reference numerals as those in the first embodiment are therefore given to the same components in the second embodiment, and description of those same components is omitted.

Description will be given below of the releasing layer 5 and the heat-resisting layer 6.

[Releasing layer]

The releasing layer 5 is formed on the black dye layer 3 in order to prevent the black dye layer 3 from being stuck onto the image receiving sheet. There may be used as a releasing layer 5 a layer on the surface of which inorganic powdery material is adhered, or a layer made of resin having an excellent releasability such as silicone copolymer, acrylic polymer, fluoridated polymer or the like. The releasing layer 5 has a thickness of from 0.01 to 5 $\mu$m, preferably of from 0.05 to 2 $\mu$m in a drying condition.

The similar effect provided by the releasing layer 5 may be taken by including such material having an excellent releasability in the black dye layer 3 without forming the above-described releasing layer 5.

[Heat-resisting layer]

The heat-resisting layer 6 is formed on the other surface of the substrate film 2 in order to prevent the occurrence of adverse effects such as sticking, wrinkled printing or the like due to heat by the thermal head. A primer layer may be formed between the substrate 2 and the heat-resisting layer 6, as the occasion demands.

The heat-resisting layer 6 may be formed in the conventional manner, for example by adding surfactant, lubricant such as oil, organic metallic salt or wax, and additive such as talc to modified resin such as thermosetting resin or silicone resin or the combination of such a modified resin and a crosslinking agent, dissolving or dispersing these materials into an appropriate solvent to prepare a heat-resisting layer forming composition, applying the thus prepared heat-resisting layer forming composition onto the other surface of the substrate film 2 by means of the conventional method of gravure printing, screen printing, reverse-roll coating using gravure plates, or the like, and drying same.

Figure 3:
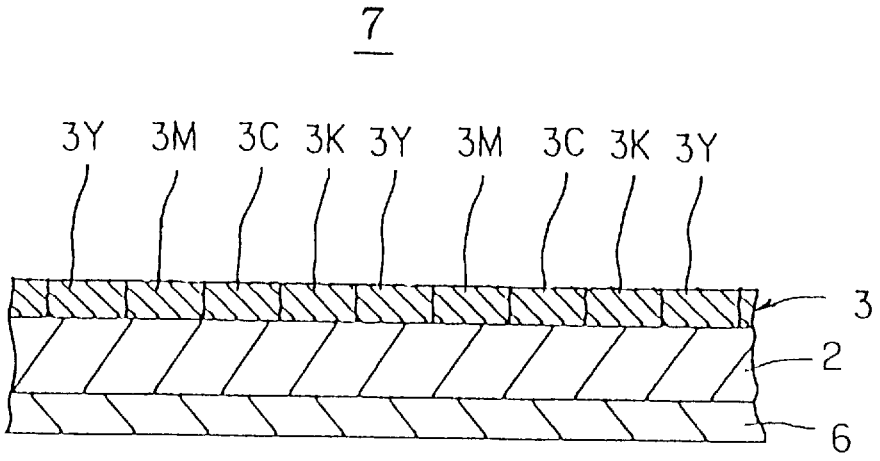
FIG. 3 is a schematic cross sectional view illustrating a black thermal transfer sheet of the third embodiment of the present invention.

Then, the black thermal transfer sheet of the third embodiment of the present invention will be described in detail with reference to FIG. 3. FIG. 3 is a schematic cross sectional view illustrating the black thermal transfer sheet of the aforementioned third embodiment of the present invention.

As shown in FIG. 3, the black thermal transfer sheet 4 of the third embodiment of the present invention comprises a substrate film 2, a black dye layer 3 formed on one surface of the substrate film 2, and a heat-resisting layer 6 formed on the other surface of the substrate film 2.

More specifically, the black thermal transfer sheet 7 of the third embodiment of the present invention is identical to the black thermal transfer sheet 4 of the second embodiment of the present invention except that the former is not provided with the releasing layer 5. The same reference numerals as those in the second embodiment are therefore given to the same components in the third embodiment, and description of those same components is omitted.

EXAMPLES

Now, the present invention will be described hereinbelow in more detail with reference to Experiment Examples and Comparative Examples. In the description appearing hereinafter, part(s) and percentage (%) are part(s) by weight and weight percentage, respectively, unless otherwise noted specifically.

Black thermal transfer sheets of the Experiment Example Nos. 1 to 3 and the Comparative Example Nos. 1 and 2 were prepared as follows:

[Experiment Example No. 1]

A polyethylene terephthalate film having a thickness of 6 $\mu$m was used as a substrate film. On the one surface of the substrate film, a black dye layer forming composition No. 1 having the chemical composition described below was applied by means of the gravure coating machine. The thus applied composition was dried to form a black dye layer having a thickness of 1 $\mu$m in a drying condition on the one surface of the substrate film.

<Black dye layer forming composition No. 1>

| | |
|---|---|
| (a) Dye No. 4 (violet) in TABLE 1: | 1.15 parts |
| (b) Dye No. 2 (orange) in TABLE 2: | 1.15 parts |
| (c) Dye of cyan expressed by the following formula (4): | 3.80 parts |

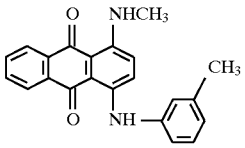

(4)

| | |
|---|---|
| (d) Dye of yellow expressed by the following formula (5): | 0.90 parts |

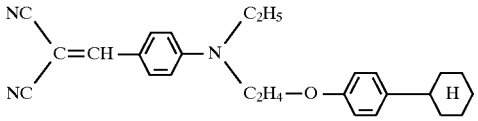

(5)

| | |
|---|---|
| (e) Polyvinyl acetoacetal resin: | 3.50 parts |
| (f) Toluene: | 44.75 parts |
| (g) Methyl ethyl ketone: | 44.75 parts |

Then, on the other surface of the substrate film, a heat-resisting layer forming composition having the chemical composition described below was applied by means of the gravure coating machine. The applied composition was dried to form a heat-resisting layer having a thickness of 1 $\mu$m in a drying condition on the other surface of the substrate film. The thus formed heat-resisting layer was subjected to a curing treatment by heating the heat-resisting layer at a temperature of 60° in an oven for a period of five days to cure same.

| <Heat-resisting layer forming composition> | |
|---|---|
| (a) Polyvinyl butylal resin (having the product name "ESLECK BX-1" manufactured by SEKISUI KAGAKU KOGYO KABUSHIKI KAISHA): | 3.6 parts |
| (b) Polyisocyanate (having the product name "BAR-NOCK D750" manufactured by DAINIPPON INK KABUSHIKI KAISHA): | 8.6 parts |
| (c) Phosphate ester surface-active agent (having the product name "PLYSURF A208S" manufactured by DAIICHI KOGYO SEIYAKU KABUSHIKI KAISHA): | 2.8 parts |
| (d) Talc (having the product name "MICROACE P-3" manufactured by NIPPON TALC KABUSHIKI KAISHA): | 0.7 parts |
| (e) Methyl ethyl ketone: | 32.0 parts |
| (f) Toluene: | 32.0 parts |

Thus, there was prepared a black thermal transfer sheet of the Experiment Example No. 1 of the present invention, which had the black dye layer and the heat-resisting layer.

[Experiment Example No. 2]

There was prepared a black thermal transfer sheet of the Experiment Example No. 2 of the present invention in the same manner as in the Experiment Example No. 1 except that the black dye layer forming composition No. 1 was substituted by the black dye layer forming composition No. 2 having the chemical composition described below.

| <Black dye layer forming composition No. 2> | |
|---|---|
| (a) Dye No. 4 (violet) in TABLE 1: | 1.25 parts |
| (b) Dye No. 1 (orange) in TABLE 2: | 1.35 parts |
| (c) Dye No. 1 (cyan) in TABLE 3: | 2.30 parts |
| (d) Dye of cyan expressed by the above-mentioned formula (4): | 1.00 parts |
| (e) Dye of yellow expressed by the above-mentioned formula (5): | 1.10 parts |
| (f) Polyvinyl acetoacetal resin: | 3.50 parts |
| (g) Toluene: | 44.75 parts |
| (h) Methyl ethyl ketone: | 44.75 parts |

[Experiment Example No. 3]

There was prepared a black thermal transfer sheet of the Experiment Example No. 3 of the present invention in the same manner as in the Experiment Example No. 1 except that the black dye layer forming composition No. 1 was substituted by the black dye layer forming composition No. 3 having the chemical composition described below.

| <Black dye layer forming composition No. 3> | |
|---|---|
| (a) Dye No. 4 (violet) in TABLE 1: | 1.30 parts |
| (b) Dye No. 1 (orange) in TABLE 2: | 1.50 parts |
| (c) Dye No. 1 (cyan) in TABLE 3: | 3.00 parts |
| (d) Dye of yellow expressed by the above-mentioned formula (5): | 1.20 parts |
| (e) Polyvinyl acetoacetal resin: | 3.50 parts |
| (f) Toluene: | 44.75 parts |
| (g) Methyl ethyl ketone: | 44.75 parts |

[Comparative Example No. 1]

There was prepared a black thermal transfer sheet of the Comparative Example No. 1 outside the scope of the present invention in the same manner as in the Experiment Example No. 1 except that the black dye layer forming composition No. 1 was substituted by the black dye layer forming composition No. 4 having the chemical composition described below.

| <Black dye layer forming composition No. 4> | |
|---|---|
| (a) Dye of cyan expressed by the above-mentioned formula (4): | 4.76 parts |
| (b) Dye of yellow expressed by the above-mentioned formula (5): | 1.47 parts |
| (c) Dye of magenta expressed by the following formula (6): | 1.47 parts |

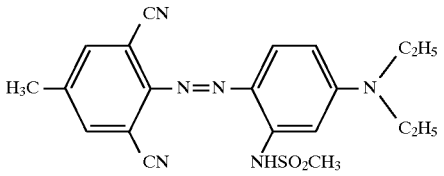

(6)

| | |
|---|---|
| (d) Polyvinyl acetoacetal resin: | 3.50 parts |
| (e) Toluene: | 44.40 parts |
| (f) Methyl ethyl ketone: | 44.40 parts |

[Comparative Example No. 2]

There was prepared a black thermal transfer sheet of the Comparative Example No. 2 outside the scope of the present invention in the same manner as in the Experiment Example No. 1 except that the black dye layer forming composition No. 1 was substituted by the black dye layer forming composition No. 5 having the chemical composition described below.

| <Black dye layer forming composition No. 5> | |
|---|---|
| (a) Dye of cyan expressed by the above-mentioned formula (4): | 4.75 parts |
| (b) Dye of yellow expressed by the following formula (7): | 2.10 parts |

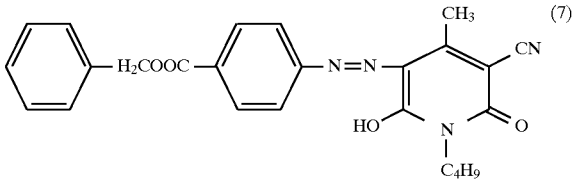

(7)

| | |
|---|---|
| (c) Dye of magenta expressed by the above-mentioned formula (6): | 1.45 parts |
| (d) Polyvinyl acetoacetal resin: | 3.50 parts |
| (e) Toluene: | 44.10 parts |
| (f) Methyl ethyl ketone: | 44.10 parts |

Then, a plurality of image receiving sheets were prepared as follows, in order to evaluate the black thermal transfer sheets of the Experiment Example Nos. 1 to 3 and the Comparative Example Nos. 1 and 2.

A sheet of synthetic paper (having the product name "YUPO FPC#150" manufactured by OHJI YUKA CO. LTD.) was used as a substrate film for the image receiving sheet. A receptor layer forming composition having the chemical composition described below was applied on one surface of the substrate film so that an applied amount thereof in a drying condition was 10.0 g/m$^2$. The thus applied composition was dried at a temperature of 100° for 30 minutes to prepare the image receiving sheet to which an image was to be transferred.

| <Receptor layer forming composition> | |
|---|---|
| (a) Polyester resin (having the product name "VYLON 200" manufactured by TOYOBO CO., LTD.): | 11.5 parts |

-continued

| <Receptor layer forming composition> | |
|---|---|
| (b) Vinyl chloride-vinyl acetate copolymer (having the product name "VYHH" manufactured by UNION CARBIDE CO., LTD.): | 5.0 parts |
| (c) Amino-modified silicone (having the product name "KF-393" manufactured by SHINETSU KAGAKU KOGYO K.K.): | 1.2 parts |
| (d) Epoxy-modified silicone (having the product name "X-22-343" manufactured by SHINETSU KAGAKU KOGYO K.K.): | 1.2 parts |
| (e) Methyl ethyl ketone: | 46 parts |
| (f) Toluene: | 46 parts |

Each of the black thermal transfer sheets of the Experiment Example Nos. 1 to 3 and the Comparative Example Nos. 1 and 2 was placed on the image receiving sheet described above so that the black dye layer of the former was brought into contact with the receptor layer of the latter. For each of the combination of them, thermal transfer recording was conducted with the use of a thermal head arranged at the back surface side (i.e., the other surface side) of the black thermal transfer sheet under conditions of a head-impressing voltage of 15.1 V and a printing velocity of 8 m/second, to form a recorded portion on the image receiving sheet. The thus formed recorded portion thereon was evaluated in transmission density, light stability and color rendering property in accordance with the following methods:

<Evaluation in transmission density>

The transmission density at the recorded portion of each image receiving sheet was measured by means of Macbeth's transmission-reflection densitometer RD-918.

<Evaluation in light stability>

With the use of Atlas's xenon fade meter C135A, light was applied to the recorded portion of the image receiving sheet under the following conditions:

(a) Black panel temperature: 50° C.

(b) Illumination intensity: 50 kLux (c) Illumination time: 50 hours, and discoloration rate by light was obtained.

<Evaluation in color rendering property>

Values of chromaticity "L", "a" and "b" were measured by means of Minolta's spectral colorimeter CM-1000 in the light sources D65 and F6, color difference between the above-mentioned two light sources was calculated in accordance with the following formula:

$$\text{Color difference}=[\{a^*(D65)-a^*(F6)\}^2+\{b^*(D65)-b^*(F6)\}^2]^{1/2}$$

where, a* (D65) and b* (D65) are values of chromaticity in the light source D65, and a* (F6) and b* (F6) are values of chromaticity in the light source F6.

Evaluation results are shown in TABLE 4 below.

TABLE 4

| | Transmission density | Light stability (%) | Color difference |
|---|---|---|---|
| Experiment Example No. 1 | 1.98 | 22 | 1.61 |
| Experiment Example No. 2 | 2.13 | 24 | 0.94 |
| Experiment Example No. 3 | 2.12 | 22 | 1.20 |
| Comparative Example No. 1 | 1.75 | 21 | 2.13 |
| Comparative Example No. 2 | 1.73 | 31 | 3.16 |

As is clear from TABLE 4, any one of the black thermal transfer sheets of the Experiment Example Nos. 1 to 3 had transmission density of at least 1.98, light stability of at least 22 and color difference of up to 1.61, and all of them were excellent in transmission density, light stability and color rendering property.

On the other hand, the black thermal transfer sheets of the Comparison Example Nos. 1 and 2 were inferior to those of the Experiment Example Nos. 1 to 3 in transmission density and color rendering property. Although the black thermal transfer sheet of the Comparison Example No. 1 had a good light stability, that of the Comparison Example No. 2 was inferior in light stability and color rendering property.

According to the present invention as described in detail, since in a black thermal transfer sheet comprising a substrate film and a black dye layer formed on one surface of the substrate film, which die layer comprises dye and a binder, the above-mentioned dye comprises a first dye and a second dye respectively expressed by the formulae (1) and (2), and further comprises, as the occasion demands, a third dye expressed by the formula (3), it is possible to form an image having a high density in black color and a high color rendering property (i.e., a property that the color difference due to the different light source is small), and an excellent fastness against heat and light (i.e., a low discoloration rate by light).

What is claimed is:

1. A black thermal transfer sheet comprising a substrate film and a black dye layer formed on one surface of said substrate film, which dye layer comprises dye and a binder, wherein:

said dye comprises a first dye and a second dye respectively expressed by the following formulae (1) and (2):

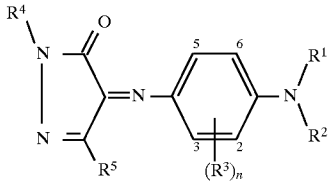

(1)

(where, "$R^1$" and "$R^2$" represent a substitutional or non-substitutional alkyl group, a substitutional or non-substitutional cycloalkyl group, a substitutional or non-substitutional aralkyl group, or a substitutional or non-substitutional aryl group, "$R^3$" represents a hydrogen atom, a halogen atom, a cyano group, a hydroxyl group, a substitutional or non-substitutional alkyl group, a substitutional or non-substitutional alkoxy group, a substitutional or non-substitutional cycloalkyl group, a substitutional or non-substitutional aralkyl group, a substitutional or non-substitutional aryl group, a substitutional or non-substitutional acyl group, a substitutional or non-substitutional acylamino group or a substitutional or non-substitutional sulfonylamino group, "$R^4$" represents a substitutional or non-substitutional alkyl group, a substitutional or non-substitutional cycloalkyl group, a substitutional or non-substitutional aralkyl group, and "$R^5$" represents a substitutional or non-substitutional aminocarbonyl group, a substitutional or non-substitutional alkoxycarbonyl group or a substitutional or non-substitutional aryloxycarbonyl group; and "n" represents an integer of 1 or 2); and

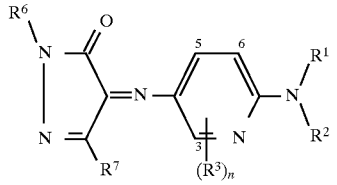

(2)

(where, "$R^1$", "$R^2$", "$R^3$" and "n" represent the same definitions as those in the formula (1), and "$R^6$" and "$R^7$" represent a substitutional or non-substitutional alkyl group, a substitutional or non-substitutional cycloalkyl group, a substitutional or non-substitutional aralkyl group, or a substitutional or non-substitutional aryl group).

2. A black thermal transfer sheet as claimed in claim 1, wherein:

said dye further comprises a third dye expressed by the following formula (3):

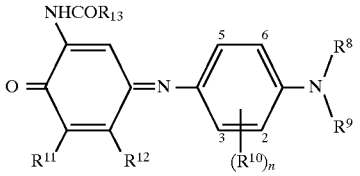

(3)

(where, "$R^8$" and "$R^9$" represent a substitutional or non-substitutional alkyl group, a substitutional or non-substitutional cycloalkyl group, a substitutional or non-substitutional aralkyl group, or a substitutional or non-substitutional aryl group, "$R^{10}$" represents a hydrogen atom, a halogen atom, a cyano group, a hydroxyl group, a substitutional or non-substitutional alkyl group, a substitutional or non-substitutional alkoxy group, a substitutional or non-substitutional cycloalkyl group, a substitutional or non-substitutional aralkyl group, a substitutional or non-substitutional aryl group, a substitutional or non-substitutional acyl group, a substitutional or non-substitutional acylamino group or a substitutional or non-substitutional sulfonylamino group, "$R^{11}$" represents a hydrogen atom or a halogen atom, "$R^{12}$" represents a hydrogen atom or a substitutional or non-substitutional alkyl group, "$R^{13}$" represents a substitutional or non-substitutional alkyl group, a substitutional or non-substitutional cycloalkyl group, a substitutional or non-substitutional aralkyl group, a substitutional or non-substitutional aryl group or a substitutional or non-substitutional alkoxy group; and "n" represents an integer of 1 or 2).

* * * * *